US006215380B1

(12) United States Patent
Schrumpf et al.

(10) Patent No.: US 6,215,380 B1
(45) Date of Patent: Apr. 10, 2001

(54) ELECTROMAGNETIC RELAY

(75) Inventors: Hans Schrumpf, Oberasbach; Sonja Reitenspiess, Nuremberg, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/522,157

(22) Filed: Mar. 9, 2000

(30) Foreign Application Priority Data

Mar. 10, 1999 (DE) ..... 299 04 380 U

(51) Int. Cl.[7] ..... H01H 51/22; H01H 13/04; H01H 9/02

(52) U.S. Cl. ..... 335/78; 335/202; 336/192

(58) Field of Search ..... 335/78, 83, 202, 335/79–82, 84–86, 282, 299, 278; 336/192

(56) References Cited

U.S. PATENT DOCUMENTS 5,291,166 * 3/1994 Chikira ..... 335/78

FOREIGN PATENT DOCUMENTS 34 23 270 1/1986 (DE) .

* cited by examiner

*Primary Examiner*—Ray Barrera
(74) *Attorney, Agent, or Firm*—Kenyon & Kenyon

(57) ABSTRACT

An electromagnetic relay is designed so that it can be manufactured inexpensively and is based on a small unit size. The relay has a base group and a magnet system, it being possible to manufacture these separately and join them together as preassembled modular units. The base group has a base plate in which a component having a component wire is fixed in position. The magnet system has two flat pins each of which has a hole with a sharpened edge. When the magnet system is joined together with the base group, the flat pins are pushed into the base plate, in each case the edge at the wire component forming a contact created by an insulation displacement connection. The relay is preferably used in the automotive industry, especially if installation conditions are cramped.

5 Claims, 1 Drawing Sheet

ELECTROMAGNETIC RELAY

BACKGROUND INFORMATION

An electromagnetic relay is described in German Patent No. 34 23 270. The relay includes a magnet system and a base group. Each of these modular units can be manufactured separately, so that functional testing and measurement tests can be carried out separately for each modular unit. Modular units which have been thus prepared are joined together in an assembly process, contact being created between electrical components and connector elements assigned to a base plate of the base group.

The base plate has recesses that leave space on either side of a given connector element in the area around a contact, this being designed as a weld point, so that a welding tool can be introduced.

If the contact between a connector element and a component is created in this way, the relay is more difficult to manufacture, as additional material is required for welding, stray particles and spatter have to be collected, and the tolerance for the position of the weld is very narrow.

To ensure that the welding machine can gain access to the location to be contacted, the base plate has recesses which leave space on either side of the connector element in the area around the weld point, so that a welding tool can be introduced. This is a disadvantage, as the relay has a large unit size.

SUMMARY OF THE INVENTION

The electromagnetic relay according to the present invention has the advantage that the aforementioned shortcomings can be avoided to a satisfactory degree.

To accomplish this, the base plate of the base group has a recess, which is largely filled when a component having a component wire is inserted and which is used to fix the component having the component wire in position.

A connector element, designed as a flat pin, has a hole that is created directly in the connector element, no additional material being required. When the flat pin is inserted into the base plate, this hole grasps the component wire that is fixed in position there, contact being created with the formation of an electrical contact.

An electrical contact created in this way is inexpensive to manufacture. It can be created without using additional material, and allows a small, compact relay to be manufactured, as no additional space is required on the base plate for the tool that creates the contact.

DETAILED DESCRIPTION

Figure 1:
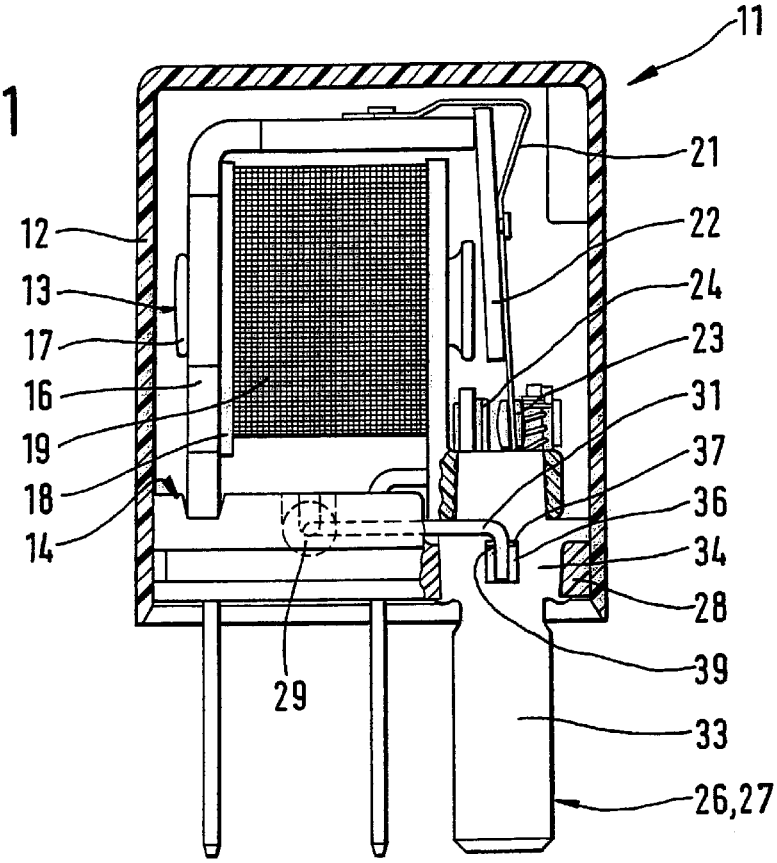
FIG. 1 shows the electrical relay in a first side view as a partial section.
Figure 2:
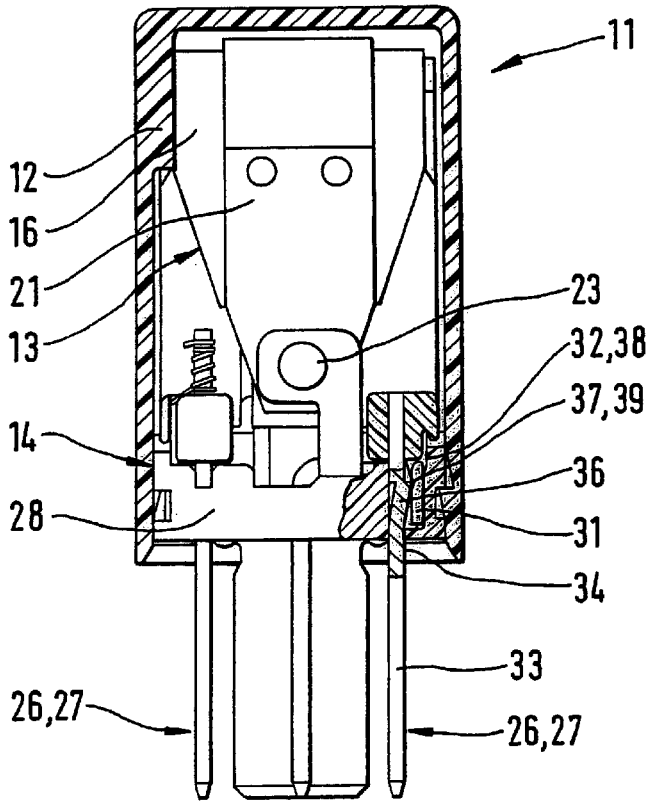
FIG. 2 shows the electrical relay in a second side view that has been rotated by 90° relative to the first, also as a partial section.

An electromagnetic relay 11 according to FIGS. 1 and 2 has a trough-shaped plastic housing 12 into which a magnet system 13 and a base group 14 can be inserted.

Magnet system 13 essentially includes an L-shaped angled magnet 16 and a magnet core 17, which bears a winding carrier 18, which is made of insulating material and has an energizing winding 19. One of the arms of angled magnet 16 is riveted to the rear end of magnet core 17. At the free end of the other arm, a bearing for a clapper-type armature 22 is formed by a leaf spring 21. At the free end of leaf spring 21, a switching contact 23 is provided which creates the contact with a make contact 24 located opposite when clapper-type armature 22 is pulled. In addition, magnet system 13 has two flat pins 27, each of which is designed as a connector element 26, which are pressed into winding carrier 18.

Base group 14 essentially includes a base plate 28 which is made of insulating material and in which connector elements 26 are seated or can be mounted. In addition, base group 14 has a component 29 having a component wire 31, which are fixed in position in a recess 32 of the base plate. Component 29 can, for example, be embodied as a resistor or a free-wheeling diode and may be connected to or connectable to a connector element 26 via a further component wire (not shown).

Each of the flat pins 27 is part of the separately manufactured modular unit of magnet system 13. Each one has a contact section 33 which, when a relay 11 has been fully assembled, protrudes from housing 12 to create a contact with an assigned mating contact (not shown).

The other part of flat pin 27 forms a connection section 34, which can be mounted in base plate 28 of the separately manufactured modular unit of base group 14. Connection section 34 has a hole 36 having a sharpened edge 37 on tongue that protrudes laterally with respect to the longitudinal extension of connection section 34.

Magnet system 13 is assembled in one assembly step by being pushed onto base plate 28, which has been prepared with component 29, component wire 31 and make contact 24, recess 32 in base plate 28 being, in the area around component wire 31, in the form of a groove 38, into which connection section 34 of flat pin 27 having hole 36 can be pressed. Herein, component wire 31 is grasped by connection section 34 and, via sharpened edge 37, creates electrical contact 39 with flat pin 27, this being an insulation displacement connection.

By using an appropriate design for base plate 28 in the area around contact 39, e.g., a resilient spring tongue, it can be ensured that the bias voltage remains largely constant at contact 39 for the entire life of the relay. In addition, this means the manufacturing tolerances at contact 39 can be relatively approximate, which is favorable in manufacturing terms.

In the case of this embodiment of contact 39, a fused joint such as a soldered or welded joint is not required. As contact 39 is easy to create by joining together magnet systems 13 and base group 14, relay 11 can be manufactured inexpensively with low manufacturing complexity, and unit sizes do not need to be large.

What is claimed is:

1. An electromagnetic relay comprising:

a base group having a base plate composed of an insulating material, the base plate having at least one recess;

a magnet system formed separately from the base group, the base group and the magnet system being joined together as preassembled modular units, the magnet system having at least one connector element for mounting in the base plate, the connector element including a flat pin having a hole, the hole being completely circumferentially surrounded by material of the flat pin; and a component having a component wire, the component being fixed in position in the at least one recess, wherein, when the magnet system is joined together with the base group, the flat pin is pushed into the base plate along at least part of a length of the flat pin, the hole and the component wire creating an electrical contact with one another.

2. The relay according to claim 1, wherein the relay is a small-sized relay.

3. The relay according to claim 1, wherein the hole on the flat pin has a sharpened edge, the sharpened edge protruding laterally with respect to a longitudinal extension of the flat pin.

4. The relay according to claim 3, wherein the recess in the base plate in an area around the component wire has a groove, a connection section of the flat pin having the hole being inserted into the groove along at least a partial section of the component wire, the sharpened edge in conjunction with the component wire forming the electrical contact, the contact being an insulation displacement connection.

5. The electromagnetic relay according to claim 1, further comprising:

a tongue, the tongue being formed via the hole.

* * * * *